US008297031B2

(12) United States Patent
Boldrini

(10) Patent No.: US 8,297,031 B2
(45) Date of Patent: Oct. 30, 2012

(54) MACHINE AND A METHOD FOR MANUFACTURING POUCHES OF COHESIONLESS MATERIAL

(75) Inventor: Fulvio Boldrini, Ferrara (IT)

(73) Assignee: Azionaria Costruzioni Macchine Automatiche A.C.M.A. S.p.A. (IT)

( * ) Notice: Subject to any disclaimer, the term of this patent is extended or adjusted under 35 U.S.C. 154(b) by 426 days.

(21) Appl. No.: 12/531,460

(22) PCT Filed: Mar. 18, 2008

(86) PCT No.: PCT/IB2008/000642

§ 371 (c)(1),
(2), (4) Date: Sep. 15, 2009

(87) PCT Pub. No.: WO2008/114122

PCT Pub. Date: Sep. 25, 2008

(65) Prior Publication Data

US 2010/0101189 A1 Apr. 29, 2010

(30) Foreign Application Priority Data

Mar. 20, 2007 (IT) ..... BO2007A0196

(51) Int. Cl.
*B65B 1/32* (2006.01)

(52) U.S. Cl. ..... 53/451; 53/272; 53/502; 53/551

(58) Field of Classification Search ..... 53/451, 53/550, 551, 552, 554, 530, 272, 273, 502
See application file for complete search history.

(56) References Cited

U.S. PATENT DOCUMENTS

| | | | | |
|---|---|---|---|---|
| 3,731,451 | A | 5/1973 | Sexstone et al. | |
| 4,520,883 | A * | 6/1985 | Fukuda | 177/1 |
| 4,524,567 | A * | 6/1985 | Patelli | 53/552 |
| 4,747,250 | A * | 5/1988 | Rossi | 53/511 |
| 4,779,402 | A * | 10/1988 | Duynhoven et al. | 53/529 |
| 4,813,205 | A * | 3/1989 | Mikata et al. | 53/53 |
| 5,199,245 | A * | 4/1993 | Daddario et al. | 53/447 |
| 5,694,741 | A * | 12/1997 | Weder et al. | 53/435 |
| 5,791,127 | A * | 8/1998 | Rossi | 53/559 |
| 5,832,700 | A * | 11/1998 | Kammler et al. | 53/502 |
| 6,314,706 | B1 | 11/2001 | Araki et al. | |
| 2010/0071711 | A1 * | 3/2010 | Boldrini | 131/112 |

FOREIGN PATENT DOCUMENTS

| | | |
|---|---|---|
| DE | 2109834 | 9/1972 |
| EP | 1063170 | 12/2000 |

OTHER PUBLICATIONS

Written Opinion and Search Report of the European Searching Authority dated Jan. 7, 2009 from counterpart PCT application.

* cited by examiner

*Primary Examiner* — Thanh Truong
(74) *Attorney, Agent, or Firm* — Timothy J. Klima; Shuttleworth & Ingersoll, PLC

(57) ABSTRACT

Pouches (2) of cohesionless material, typically a smokeless tobacco product, are manufactured on a machine equipped with feed components (101) by which the material is supplied to a conveyor (4) at a delivery station (8), then transferred by the conveyor (4) from this station (8) to a transfer station (9) where a forcing mechanism (14) directs measured portions (100) of the material from the conveyor into at least one duct (12) connecting with a form-fill-and-seal wrapping station (10) where the portions (100) are enclosed in a continuous succession (21) of pouches (2). Before being separated one from the next at a downstream cutting station (23), the single pouches (2) pass through an in-line quality control station (105) at which their weight is checked individually.

12 Claims, 3 Drawing Sheets

MACHINE AND A METHOD FOR MANUFACTURING POUCHES OF COHESIONLESS MATERIAL

This application is the National Phase of International Application PCT/IB2008/000642 filed on Mar. 18, 2008 which designated the U.S. and that International Application was published under PCT Article 21(2) in English.

This application claims priority to Italian Patent Application BO2007A000196 filed Mar. 20, 2007 and PCT/IB2008/000642 filed Mar. 18, 2008, which applications are incorporated by reference herein.

TECHNICAL FIELD

The present invention relates to a machine, and to a relative method, for manufacturing individual bags or sachets of cohesionless material, and in particular, pouches of nasal snuff, or of moist snuff (also known as snus) for oral use.

BACKGROUND ART

The prior art embraces machines of the type in question, which comprise a dispensing disc rotatable intermittently about a vertical axis and furnished with a ring of cavities, each containing a quantity or portion of tobacco that will correspond to the contents of a single pouch.

The portions are released into the single cavities at a filling station by a hopper containing a supply of powdered tobacco, en masse, treated with flavouring and moisturizing agents.

Downstream of the filling station, the machine comprises skimming means that serve to remove any excess tobacco from each of the cavities.

With the disc in rotation, the cavities are carried beyond the skimming means and toward a transfer station where the single portion of tobacco contained in each cavity is ejected.

Installed at this same station are pneumatic ejection means comprising a nozzle positioned above the dispensing disc. At each pause in the movement of the disc, a portion of tobacco is forced by the nozzle from the relative cavity into a duct, of which the mouth lies beneath the disc and in alignment with the nozzle, and toward a wrapping station where the single pouches are formed.

The wrapping station comprises a tubular element, placed at the outlet of the duct and functioning as a mandrel over which to fashion a tubular envelope of paper wrapping material.

The material in question consists of a continuous web decoiled from a roll and fed in a direction parallel to the axis of the tubular element, which is wrapped progressively around the element and sealed longitudinally.

Beyond the tubular element, the machine is equipped with transverse sealing means of which the operation is synchronized with the transfer of the tobacco portions, in such a way that each successive portion will be enclosed in a relative segment of the continuous tubular envelope of wrapping material delimited by two consecutive transverse seals.

The successive tubular segments of wrapping material, formed as pouches containing respective portions of tobacco, are separated one from the next through the action of cutting means positioned downstream of the transverse sealing means.

Once separated, the individual pouches are transferred by conveyor belts of conventional type to a station where retailable packs of appropriate design are filled with a given number of the single pouches.

A sampling step is effected periodically at a given point between the cutting station and the packing station, which involves inspecting and weighing the pouches manually.

The weights of the sampled pouches are averaged, and the resulting value is compared with a range of reference values.

In the event of the averaged weight falling outside the prescribed range, part of the output is rejected and the machine will be stopped so that the settings of feed mechanisms can be readjusted to ensure the tobacco is being portioned at the correct weight.

Machines of the type described above present certain drawbacks.

First, the method of check-weighing items on a sample basis, as described above, is one that produces a high number of rejects in the event of there being a malfunction in the machine, given that where an averaged weight value falls outside a given range of values, all pouches of the sample will be discarded.

Consequently, even pouches of correct weight will be discarded as part of the rejected sample.

Moreover, it is not always possible in these machines for defects in production to be identified immediately and accurately, since measurements are derived by sampling a given number of pouches, and not by checking every single pouch produced.

The object of the present invention is to provide a machine for manufacturing single pouches of cohesionless material that will be unaffected by the drawbacks mentioned above in connection with machines of the prior art, and able thus to ensure efficiency, precision and an extremely low percentage of reject items in production.

DISCLOSURE OF THE INVENTION

The invention will now be described in detail, by way of example, with the aid of the accompanying drawings, in which.

Figure 1:
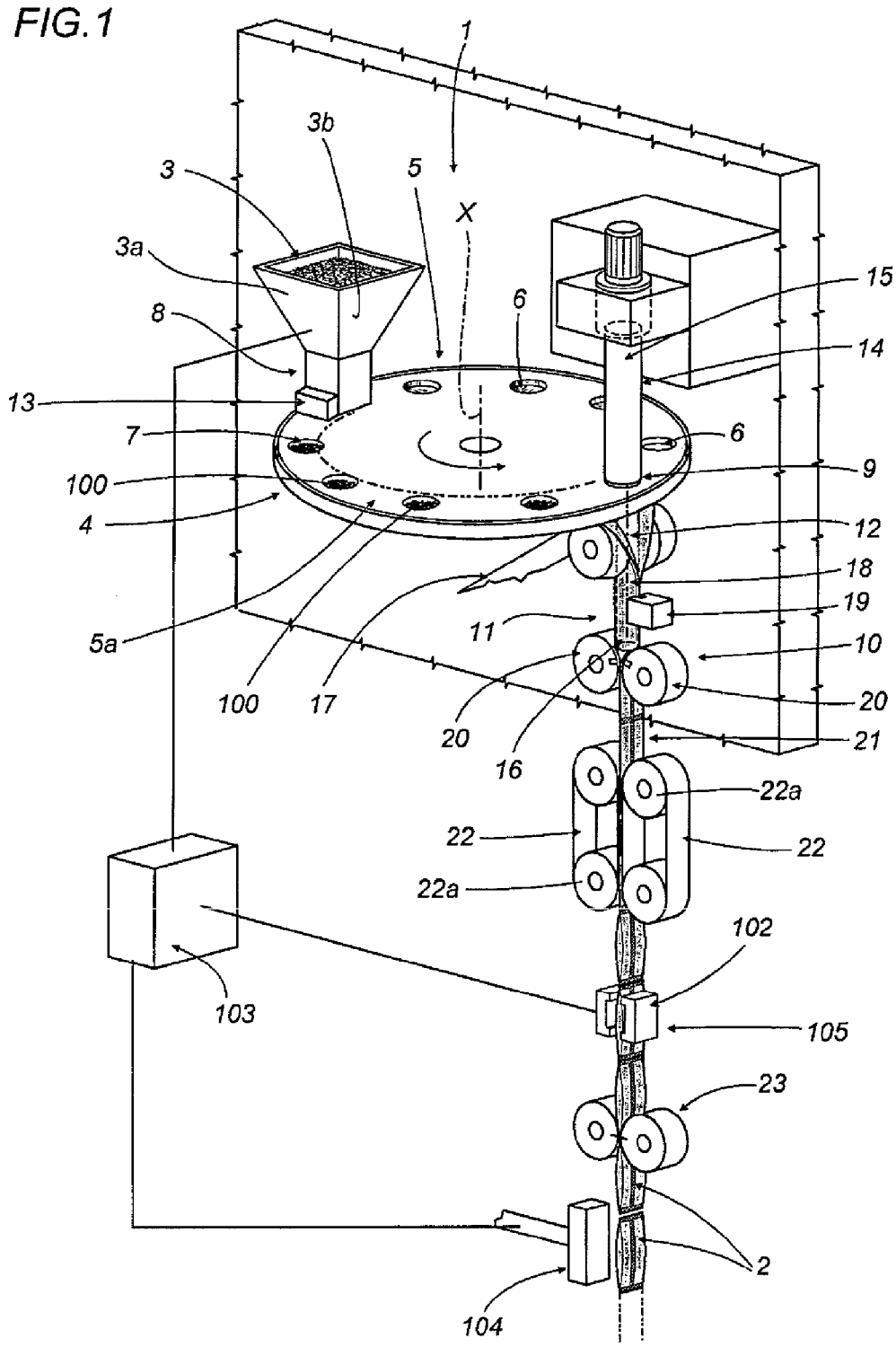
FIG. 1 shows a machine in accordance with the present invention, viewed schematically in perspective and illustrated in a first embodiment.

With reference to FIG. 1, numeral 1 denotes a machine for manufacturing pouches 2 containing a cohesionless material, in particular a smokeless tobacco product.

The machine 1 comprises a hopper 3 filled with the material in question, and conveying means 4 that consist in a conveyor 5 embodied as a dispensing disc, denoted 5*a*, furnished with a plurality of pockets 6 fashioned as bottomless cavities 7 of circular shape, arranged around the periphery.

The dispensing disc 5*a* rotates intermittently and anticlockwise (as viewed in FIG. 1) about a relative axis X, between a delivery station 8 beneath the hopper 3, where each cavity 7 is filled with a predetermined portion 100 of tobacco, and a transfer station 9 at which the successive portions 100 of tobacco are ejected from the cavities 7.

The machine 1 further comprises a form-fill-and-seal wrapping station 10 where the portions 100 of tobacco removed from the conveyor at the transfer station 9 are taken up and enclosed in respective pouches 2.

Also indicated in FIG. 1 are interconnecting means 11, embodied as a rectilinear duct 12, interposed between the transfer station 9 and the wrapping station 10.

Numeral 13 denotes skimming means located downstream of the hopper 3, as referred to the direction of rotation of the disc, and serving to remove any excess tobacco from the cavity 7.

The hopper and the skimming means together constitute feed means 101 by which the cohesionless material is dispensed and portioned.

Referring to FIGS. 1 and 1*a*, the transfer station 9 incorporates pneumatic forcing means 14, located above the disc 5*a*, comprising a tubular element 15 of diameter substantially equal to the diameter of the cavities 7, aligned on a vertical axis and divided internally by radial walls 15*a* into four sectors 15*b*, which is connected uppermost to a source of compressed air (not illustrated).

The wrapping station 10 comprises a tubular mandrel 16 positioned at the outlet end of the rectilinear duct 12, around which a continuous web 17 of wrapping material is formed into tubular envelope 18.

The web of material 17 is decoiled from a roll (not illustrated) and wrapped around the tubular mandrel 16, by degrees, through the agency of suitable folding means.

The edges of the web are joined and sealed longitudinally to form the tubular envelope 18 by ultrasonic welders 19 located in close proximity to the tubular mandrel 16.

Figure 2:
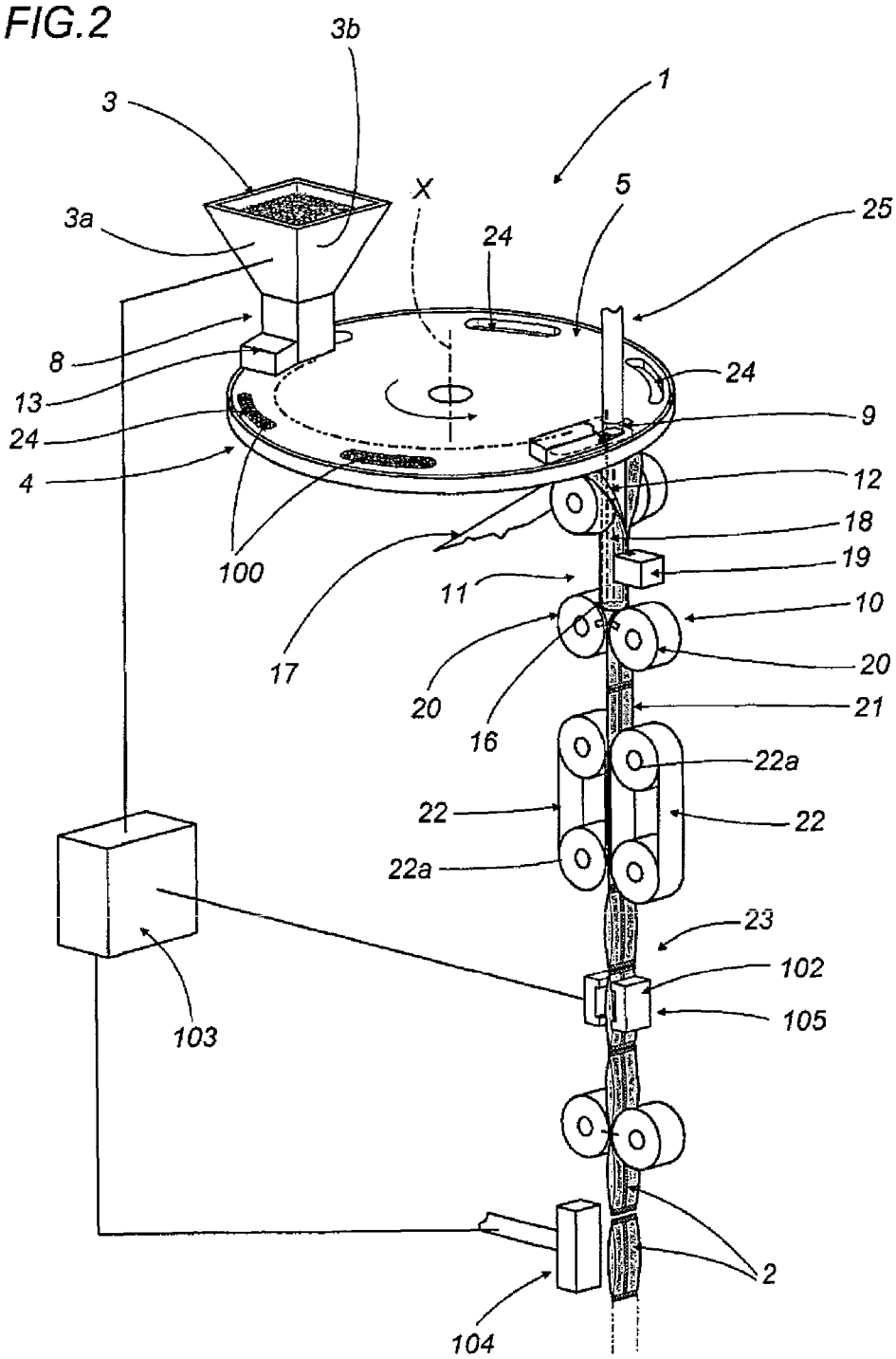
FIG. 2 shows a machine in accordance with the present invention, viewed schematically in perspective and illustrated in a second embodiment.

Referring to FIGS. 1 and 2, the machine 1 also comprises sealing means 20 located beneath the tubular mandrel 16, of which the function is to bond the tubular envelope 18 transversely and thus form a continuous succession 21 of pouches 2, each containing a single portion 100 of tobacco. The transverse sealing means 20 are followed downstream by a pair of transport belts 22 looped around respective pairs of pulleys 22*a*, serving to advance the continuous succession 21 of pouches 2 toward cutting means 23 by which the single pouches 2 of the selfsame succession 21 are divided one from the next.

As illustrated in FIG. 1, the machine further comprises a microwave emitter device 102 interposed between the paired transport belts 22 and the cutting means 23, through which the single pouches 2 of the continuous succession 21 are caused to pass, and of which the function is to sense the mass density of the tobacco particles contained in each of the pouches 2 making up the succession 21.

The microwave emitter device 102 is connected to a master control unit 103 programmed to calculate the weight of each pouch 2, on the basis of the density sensed by the emitter device, and compare the resulting value with a previously selected range of reference values.

The master control unit 103 is connected to the aforementioned tobacco feed means 101, and to an expulsion device 104 positioned to engage the pouches 2 at a point downstream of the cutting means 23.

The emitter device provides means 105 by which the weight of the pouches can be checked in line.

In operation, with the disc 5*a* set in rotation, the cavities 7 are directed one by one under the hopper 3 and filled with respective portions 100 of tobacco, each destined to provide the contents of one pouch 2.

Each cavity 7 then passes under the skimming means 13, which will remove any excess tobacco released from the hopper.

Thereafter, the cavities 7 advance in succession toward the transfer station 9 and are positioned under the tubular element 15.

At this point, a pneumatic selector, schematized in FIG. 1 as a block 14*a*, connects the four sectors 15*b* of the tubular element 15 sequentially to the source of compressed air in such a way that corresponding jets are directed in succession onto different areas of the portion 100 of tobacco contained in the cavity 7.

As a result, the portion 100 of tobacco is removed by degrees from the respective cavity 7 and directed gradually into the duct 12 beneath.

Forced downward by the air jets, the portion 100 of tobacco passes along the rectilinear connecting duct 12 and into the tubular mandrel 16, which is ensheathed by the web 17 of wrapping material.

The envelope 18 obtained from the web of paper material is sealed lengthwise by the ultrasonic welders 19, and crosswise, at the outlet end of the tubular mandrel 16, by the transverse sealing means 20.

The operation of the transverse sealing means 20 is intermittent, and timed to match the frequency at which successive portions 100 of tobacco are fed into the transfer station 9, in such a way that each portion 100 of tobacco will be enclosed between two successive transverse seals.

Thus, a continuous succession 21 of tobacco-filled pouches 2 will emerge, connected one to the next by way of the transverse seals.

The continuous succession 21 of pouches 2 is advanced by the transport belts 22 toward the microwave emitter device 102, which detects the mass density of each pouch 2 and sends a corresponding signal to the master control unit 103, which in turn will calculate the weight of the single pouch 2 from the mass density measurement.

In the event that the detected weight of a pouch 2 should be out of range, the master control unit 103 sends a first signal to the expulsion device 104, which will remove the pouch 2 in question from the production line.

The control unit 103 also forms part of a feedback loop with the tobacco feed means 101, to which it is linked in such a way that defects in the weight of the pouches 2 can be corrected.

At a given point downstream of the emitter device 102, the single pouches 2 are separated one from the next by the cutting means 23.

In the embodiment of FIG. 2, the pockets of the dispensing disc 5*a* are fashioned as elongated slots 24 and the forcing means consist in a single pneumatic nozzle 25 positioned at the transfer station 9.

In this instance, the portions 100 of tobacco are transferred from the slots 24 to the duct 12 with the disc 5*a* in rotation, as each single slot 24 passes beneath the nozzle 25.

Likewise in this solution, the transfer of the portions 100 of tobacco into the rectilinear duct 12 occurs gradually.

Figure 3:
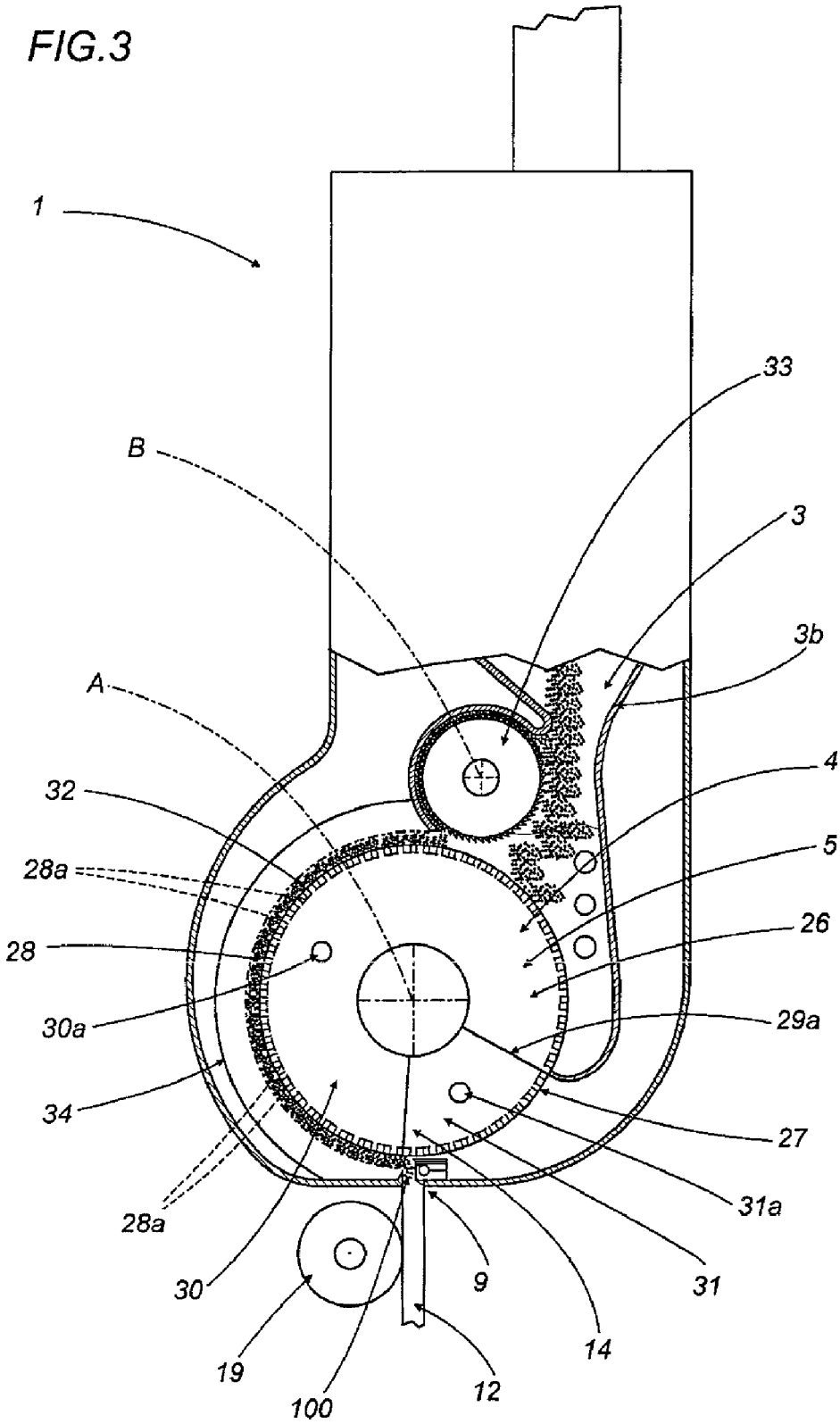
FIG. 3 shows a third embodiment of a machine according to the present invention, viewed schematically in a front elevation.

In a further embodiment (see FIG. 3), the conveying means 4 appear as a drum 26 rotatable intermittently and anticlockwise, as viewed in the drawing, about a horizontal axis A. The drum 26 is interposed between a bottom end of the hopper 3, delimited by two side walls 3*a* and 3*b*, and the transfer station 9.

The drum 26 presents a cylindrical wall 27 with a band 28 of predetermined width rendered permeable to air by a plurality of through holes 28*a*.

The enclosure 29 delimited by the cylindrical wall 27 is divided by two radial walls 29*a* and 29*b* into two sectors, denoted 30 and 31.

A first sector 30, located adjacent to the outlet of the hopper 3 and extending around to the transfer station 9, is connected by way of a duct 30*a* to a source of negative pressure (not illustrated).

The remaining sector 31, positioned adjacent to and above the transfer station 9, is angularly complementary to the first sector 30 and connected by way of a further duct 31*a* to a source of compressed air (not illustrated).

In operation, with the drum 26 set in rotation and exposed to the aspirating action of the negative pressure source, the air-permeable band 28 will gradually collect a continuous stream 32 of tobacco, which is kept at a prescribed and constant thickness through the action of a levelling roller 33 rotating similarly anticlockwise about an axis B parallel to the axis A aforementioned, internally of the hopper 3 and adjacent to one side wall 3*a*.

The continuous stream 32 advances between two side panels 34 extending concentrically with the drum 26 as far as the transfer station 9, where a given length of the stream 32, corresponding in quantity to one portion 100, will be detached gradually from the drum by a jet of compressed air forced through the holes 28*a* of the air-permeable band 28, and directed into the duct 12 in the manner described previously with reference to other embodiments.

It will be seen that the forcing means 14, which are pneumatic in the various embodiments described thus far, might also be of mechanical design.

In an alternative embodiment of the machine, not illustrated, the forcing means might be embodied as a mechanical plunger invested with reciprocating motion and insertable through the cavities of the dispensing disc when positioned at the transfer station.

The microwave emitter device 102 might also be substituted by a gamma ray device or a beta ray device.

The elements of the design as described above are readily applicable to a twin track type of machine.

In this instance, the conveying means will consist either in a disc with two rings of cavities, or a drum with two air-permeable bands, in such a way that two portions of tobacco can be supplied simultaneously to the transfer station, and each then directed into a respective duct.

Self-evidently, adopting the machine according to the present invention, the aforementioned drawbacks connected with the prior art can be overcome, inasmuch as a weight check is conducted on every single pouch produced, rather than on predetermined samples only.

With the present invention, moreover, it becomes possible to reject only those pouches of which the weight registers outside the predetermined range of reference values, since the weight check is conducted on each single pouch rather than using an average value calculated on a relatively large number of pouches.

Finally, by connecting the control unit and the tobacco feed means as part of a feedback loop, any defects in production can be corrected automatically and in-line, without having to interrupt the operation of the machine

The invention claimed is:

1. A machine for manufacturing pouches of cohesionless material, comprising a feed mechanism for feeding the cohesionless material to a conveying mechanism at a delivery station, from where the cohesionless material is transported by the conveying mechanism to a transfer station;

a forcing mechanism, operating at the transfer station, for directing predetermined single portions of the cohesionless material from the conveying mechanism into at least one connecting duct associated with a wrapping station where the single portions are enclosed in a continuous succession of pouches;

a cutting mechanism for dividing the continuous succession of pouches one from a next, a weight checking mechanism positioned upstream of the cutting mechanism for checking a weight of each pouch while still attached to other pouches in the continuous succession of pouches.

2. A machine as in claim 1, wherein the weight checking mechanism is located between the wrapping station and the cutting mechanism.

3. A machine as in claim 1, comprising a master control unit associated with the weight checking mechanism and with the feed mechanism.

4. A machine as in claim 1, wherein the weight checking mechanism comprises a microwave emitter device.

5. A machine as in claim 1, wherein the weight checking mechanism comprises a beta ray emitter.

6. A machine as in claim 1, wherein the weight checking mechanism comprises a gamma ray emitter.

7. A machine as in claim 1, comprising an expulsion device associated with the master control unit for removing reject pouches.

8. A machine as in claim 1, wherein the conveying mechanism comprises a dispensing disc with cavities, rotatable about a given axis, and the forcing mechanism comprises a mechanical pushing mechanism for engaging at least one of the cavities.

9. A machine as in claim 1, wherein the conveying mechanism comprises a dispensing disc with cavities, rotatable about a given axis, and the forcing mechanism comprises a pneumatic mechanism for gradually ejecting the cohesionless material making up each single portion from one of the cavities.

10. A machine as in claim 9, wherein the conveying mechanism comprises an aspirating conveyor on which a continuous stream of the cohesionless material is formed.

11. A method for manufacturing pouches of cohesionless material, including the steps of:

supplying the cohesionless material to a conveying mechanism via use of a feed mechanism, at a delivery station;

directing the cohesionless material, via the conveying mechanism, from the delivery station to a transfer station;

transferring predetermined portions of the cohesionless material, via a forcing mechanism operating at the transfer station, from the conveyor mechanism to at least one duct connecting with a wrapping station where the pouches are formed, filled and sealed;

checking a weight of each pouch while still attached to other pouches in a continuous succession of pouches exiting the wrapping station and upstream of a cutting station for cutting the continuous succession of pouches one from a next.

12. A machine as in claim 11, further comprising utilizing a feedback loop to control a quantity of material supplied by the feed mechanism.

* * * * *